US008371398B2

(12) United States Patent
Miller et al.

(10) Patent No.: US 8,371,398 B2
(45) Date of Patent: Feb. 12, 2013

(54) DOWNHOLE FLUID LOSS CONTROL APPARATUS

(75) Inventors: Troy A. Miller, Bellville, TX (US); Edward T. Wood, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 2296 days.

(21) Appl. No.: 10/969,388

(22) Filed: Oct. 20, 2004

(65) Prior Publication Data

US 2006/0081401 A1 Apr. 20, 2006

(51) Int. Cl.
*E21B 10/64* (2006.01)

(52) U.S. Cl. ..... 175/171; 175/257

(58) Field of Classification Search ..... 166/332.5, 166/80.1, 334.1, 386, 387, 179, 332.4; 175/317, 175/318, 171, 257
See application file for complete search history.

(56) References Cited

U.S. PATENT DOCUMENTS

| | | | | |
|---|---|---|---|---|
| 2,942,665 | A * | 6/1960 | Davis et al. | 166/124 |
| 3,545,553 | A * | 12/1970 | Johnson et al. | 175/258 |
| 4,378,842 | A * | 4/1983 | Patel | 166/278 |
| 4,415,038 | A * | 11/1983 | Schmuck | 166/373 |
| 4,628,996 | A | 12/1986 | Arnold | |
| 4,712,613 | A | 12/1987 | Nieuwstad | |
| 5,314,014 | A * | 5/1994 | Tucker | 166/124 |
| 6,209,663 | B1 * | 4/2001 | Hosie | 175/57 |
| 6,343,658 | B2 * | 2/2002 | Webb | 166/386 |
| 6,367,566 | B1 * | 4/2002 | Hill | 175/57 |
| 6,966,373 | B2 * | 11/2005 | Von Gynz-Rekowski | 166/250.01 |
| 7,086,485 | B2 | 8/2006 | Moriarty et al. | |
| 7,090,039 | B2 * | 8/2006 | Van Wijk | 175/393 |
| 2003/0098155 | A1 * | 5/2003 | Guillory et al. | 166/242.6 |
| 2004/0026126 | A1 | 2/2004 | Angman | |
| 2004/0112603 | A1 | 6/2004 | Galloway et al. | |
| 2004/0112639 | A1 | 6/2004 | Chen et al. | |
| 2004/0112646 | A1 | 6/2004 | Vail, III et al. | |
| 2004/0129424 | A1 | 7/2004 | Hosie et al. | |

OTHER PUBLICATIONS

Be. Paul Bercegeay, et al., "A One-Trip Gravel Packing System", SPE 4771; Feb. 1974; 12 pages.
Stephen P. Mathis; Sand Management: A Review of Approaches and Concerns; SPE 82240; May 2003; 7 pages.

* cited by examiner

*Primary Examiner* — D. Andrews
(74) *Attorney, Agent, or Firm* — Steve Rosenblatt

(57) ABSTRACT

A sealing device for downhole use, one of which is for casing, when drilling with casing, which allows the casing to be closed off if the bottom hole assembly needs to come out for any reason. In one embodiment, the internal packer is triggered to set in a variety of ways upon removal of the bottom hole assembly. It can be drilled out when the new bottom hole assembly is run in later. In an alternative design, a flapper can be used that is held open for the initial insertion of the bottom hole assembly and is released to spring shut upon removal of the assembly. Multiple flappers or packers or other types of closure devices are envisioned to allow removal of the bottom hole assembly more than once and still retain blowout protection on each removal of the bottom hole assembly. A variety of applications are contemplated some of which are perforation, side tracking, fracturing, and gravel packing, to name a few examples.

15 Claims, 3 Drawing Sheets

DOWNHOLE FLUID LOSS CONTROL APPARATUS

FIELD OF THE INVENTION

The field of this invention is downhole isolation devices and particularly those that can be used during drilling or completion to provide a second closure in situations where the tree has not yet been mounted.

BACKGROUND OF THE INVENTION

Drilling with casing can be accomplished in two different ways. In on instance, a drillable casing shoe is mounted on the end of the casing and rotated down the wellbore. The other way is to lock a drilling bottom hole assembly into a profile bushing near the lower end of the casing string. Using the latter method, more complex drilling equipment can be used, such as downhole motors, directional tools, hole openers, logging or measuring while drilling tools and so on. In many instances, the entire interval can be drilled without removal of the bottom hole assembly. If any of the components of the bottom hole assembly fail or wear out, the bottom hole assembly needs to be unlatched and returned to the surface on drill pipe run in to retrieve the assembly. However, when the bottom hole assembly is removed, there is a risk that the well could kick or blow out. The act of pulling out the bottom hole assembly can cause reduced pressure beneath the bottom hole assembly, also called swabbing, which can induce the well to kick. The annulus around the casing can be closed off with standard casing blowout preventers, but presently there exists no equipment to isolate the casing interior against a well kick or a blowout.

The present invention, in one application, provides a variety of solutions that allow the casing interior to be closed off at least once during removal of the bottom hole assembly. In one embodiment, an internal packer can be triggered on removal of the bottom hole assembly. This packer can be actuated in a variety of ways such as hydrostatically or through a release of gas due to a reaction. Alternatively, a flapper valve can be installed in the casing and held open until removal of the bottom hole assembly at which time a spring can urge it to a closed position to prevent a blowout. Multiple assemblies are contemplated to allow the bottom hole assembly to be removed more than once and still get the blowout protection each time. Upon return of the bottom hole assembly into the casing, the previously set packer can be drilled out or, if a flapper has been used and sprung, then the bottom hole assembly can be simply pushed out of the way.

Other applications of the closure device of the present invention are contemplated. Some of these applications are to control fluid loss during sidetracking, fracturing, and gravel packing. Another application is during perforating to allow the spent gun to be removed with control of the well using the invention in combination with surface blowout prevention equipment. Yet other applications are contemplated to allow a second closure device in the well during a variety of operations to provide control of the well and to meet the requirements of local regulations for redundant closure devices in the event of a blowout.

These and other advantages of the present invention will be more readily appreciated by those skilled in the art from a review of the description of the preferred and other embodiments, the drawings and the claims, all of which appear below.

SUMMARY OF THE INVENTION

A sealing device for downhole use, one of which is for casing, when drilling with casing, which allows the casing to be closed off if the bottom hole assembly needs to come out for any reason. In one embodiment, the internal packer is triggered to set in a variety of ways upon removal of the bottom hole assembly. It can be drilled out when the new bottom hole assembly is run in later. In an alternative design, a flapper can be used that is held open for the initial insertion of the bottom hole assembly and is released to spring shut upon removal of the assembly. Multiple flappers or packers or other types of closure devices are envisioned to allow removal of the bottom hole assembly more than once and still retain blowout protection on each removal of the bottom hole assembly. A variety of applications are contemplated some of which are perforation, side tracking, fracturing, and gravel packing, to name a few examples.

DETAILED DESCRIPTION OF THE DRAWINGS

DETAILED DESCRIPTION OF THE PREFERRED EMBODIMENT

Figure 1:
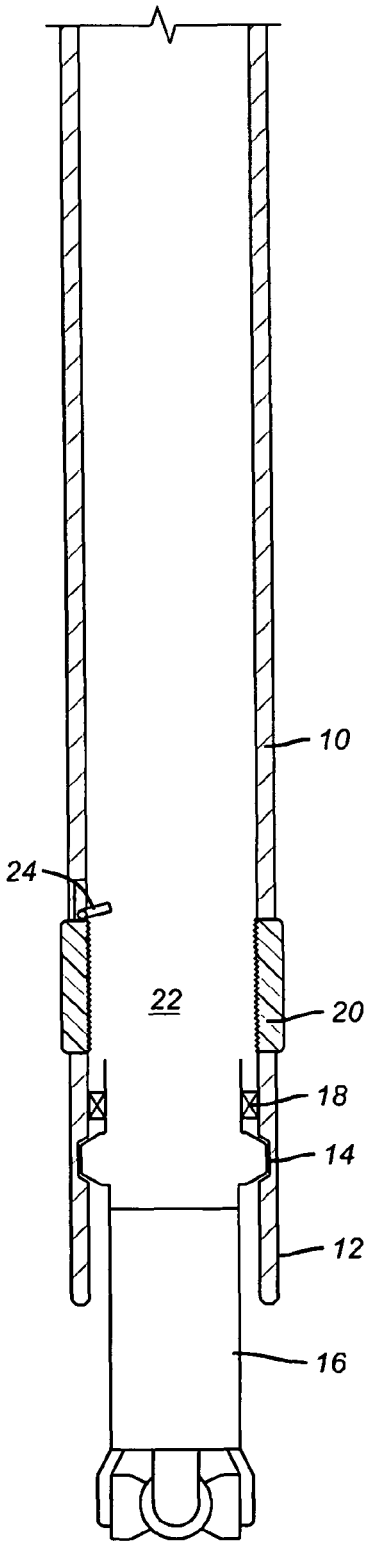
FIG. 1 shows the bottom hole assembly at the lower end of the casing just before its removal.
Figure 2:
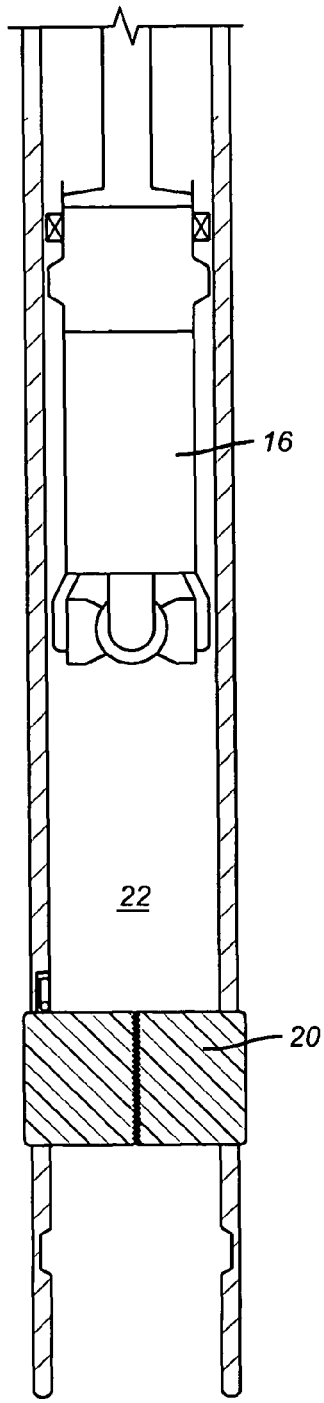
FIG. 2 is the view of FIG. 1 showing the bottom hole assembly removed and the internal packer set to prevent a blowout.
Figure 3:
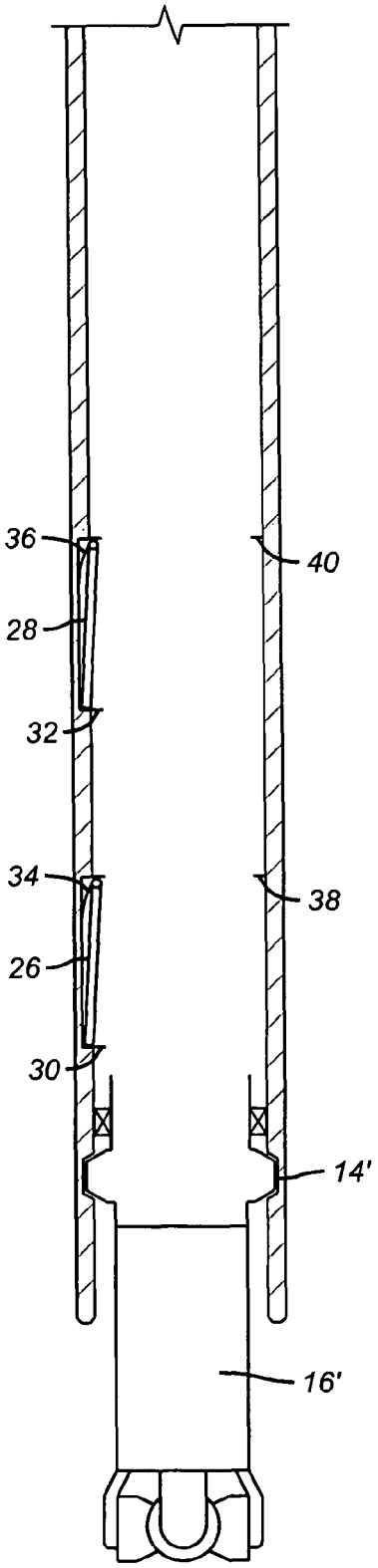
FIG. 3 is an alternative to the design in FIG. 1 using a plurality of flappers to allow multiple removals of the bottom hole assembly.

FIG. 1 illustrates a casing string 10 having a locking sub 12 at its lower end. Sub 12 has a locking groove 14 into which the schematically illustrated bottom hole assembly 16 can be latched and sealed with seal 18. Located above the groove 14 is an internal blowout preventer 20 in the run in position. In this position, the bottom hole assembly 16 can be retrieved through it through passage 22. On the way out through the preventer 20 after the bottom hole assembly has cleared it, the tripping mechanism 24 is activated to set the preventer 20, as shown in FIG. 2. As shown in FIG. 2, the bottom hole assembly 16 is isolated by preventer 20 from the wellbore below so that swabbing the wellbore will not occur because the casing string 10 is effectively internally isolated using preventer 20. Preventer 20 can be inflated or set by mechanical compression initiated by hydrostatic pressure, a stored spring force or a stored pressure source working in tandem with an atmospheric chamber or by virtue of the pull out force applied to the bottom hole assembly 16. Although one preventer 20 is illustrated, a plurality of preventers can be arranged in he casing 10. The tripping mechanisms can be such that the preventers trip in sequence starting from the lowermost unit. When the bottom hole assembly 16 is reinserted, the preventer that had previously tripped is drilled out. Upon subsequent removal of the bottom hole assembly the next preventer uphole that has yet to trip is triggered to provide continuing protection against blowouts.

FIGS. 3-6 show a sequence of insertion and removal of the bottom hole assembly 16'. In this embodiment a plurality of flappers 26 and 28 are illustrated, although only one can be used. Using more than one allows the bottom hole assembly to be removed more than once while still having blowout protection. The flappers are latched open in FIG. 3 to allow the bottom hole assembly 16' to be lowered through them for engagement in groove 14'. Latches 30 and 32 respectively hold open flappers 26 and 28. These latches can be made in a variety of styles. They can be as simple as a protrusion on the bottom hole assembly 16' tripping a lever to allow a spring 34 or 36 to operate the flappers 26 or 28 respectively to the closed position against seats 38 or 40. Alternatively the latches 30 and 32 could be j-slot mechanisms that require different manipulations of the bottom hole assembly 16' to effect release of a specific flapper. Those skilled in the art will appreciate that having multiple closure devices allows more than one removal of the bottom hole assembly 16' from the casing 10' while still allowing protection for blowouts. Different types of casing internal closures can be used together such as an inflatable and a flapper.

Figure 4:
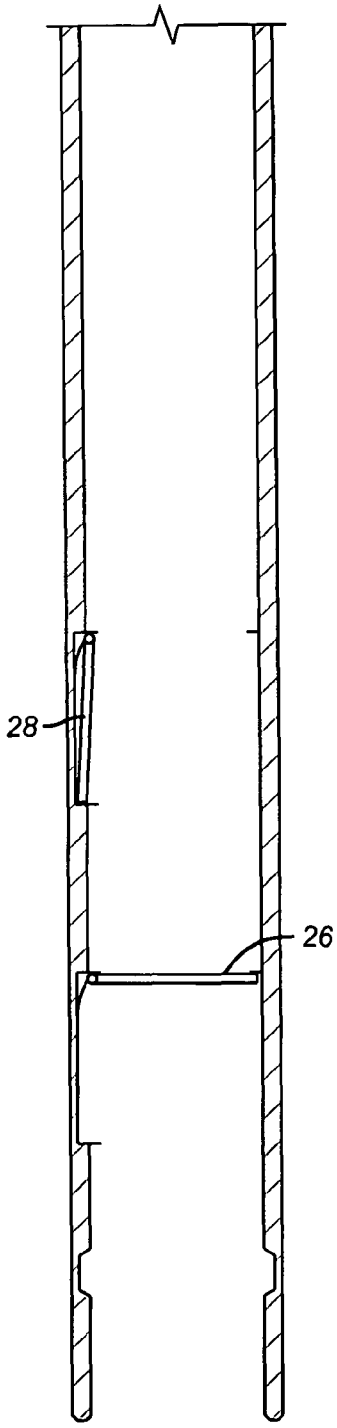
FIG. 4 is the view of FIG. 3 with the bottom hole assembly removed the first time.
Figure 5:
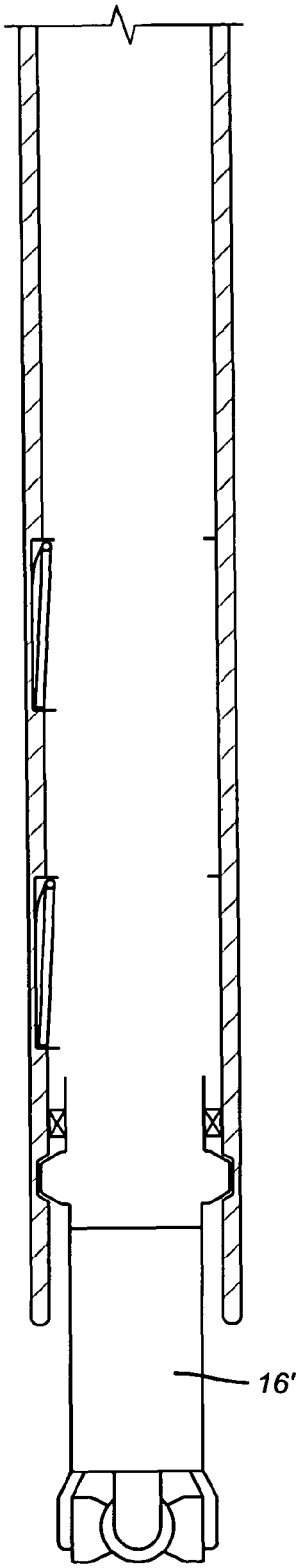
FIG. 5 is the view of FIG. 4 with the bottom hole assembly reinserted.
Figure 6:
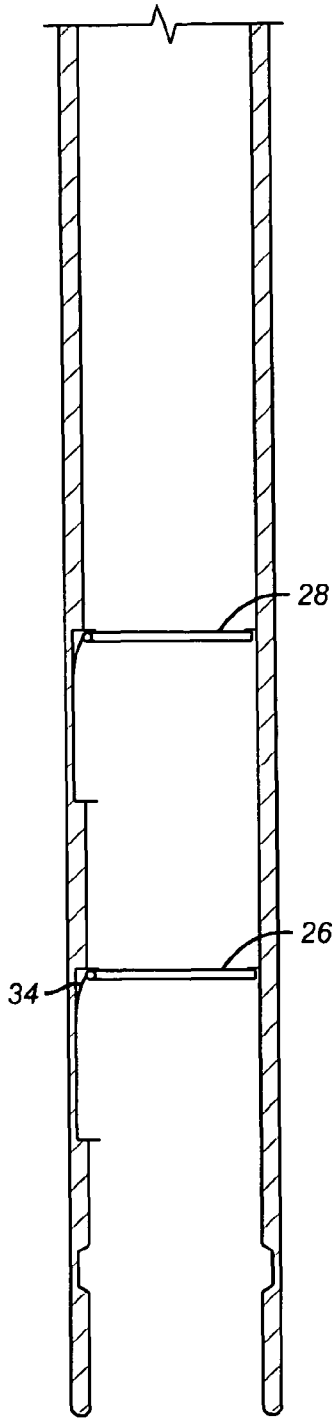
FIG. 6 is the view of FIG. 6 with the bottom hole assembly removed again and both flappers closed.

FIG. 4 shows the bottom hole assembly 16' removed and flapper 26 closed while flapper 28 remains open. Thereafter, the repaired or reconditioned bottom hole assembly 16' is reinserted and relatched to allow further drilling. The act of insertion simply displaces closed flapper 26 back to the open position, where it can relatch to be held open or the flow through the casing 10' can hold it open. When the bottom hole assembly is removed a second time flapper 26 just goes closed under the force of spring 34, if not previously relatched, or upon being unlatched, closes again as the bottom hole assembly 16' is pulled out. Similarly the upper flapper 28 can be unlatched to close against seat 40.

The applications for the present invention are diverse. The present invention can be used in applications in casing where a bottom hole assembly is inserted for an operation and subsequently needs removal one or more times. In these situations, the present invention provides a second closure to the surface blowout preventers. The invention can be used in casing for a variety of applications such as perforating, fracturing, side tracking, and gravel packing to name a few. It can also be applied in through tubing applications although the most prevalent use of the invention lends itself to drilling and completion operations where a tree is not mounted and the only other well control device that is mounted is the surface blowout preventers. Use of the invention eliminates the need to kill the well with mud or other fluids. Killing the well can affect its subsequent performance adversely. If there is mud in the well, the present invention, when activated, prevents the formation from absorbing the mud and then coming in as a blowout.

The above description is illustrative of the preferred embodiment and many modifications may be made by those skilled in the art without departing from the invention whose scope is to be determined from the literal and equivalent scope of the claims below.

We claim:

1. An assembly for performing a downhole drilling operation downhole, comprising:

a bottom hole assembly comprising a bit insertable in a tubular for selective rotationally locked support from said tubular to drill downhole while said tubular is rotated downhole, said bottom hole assembly selectively removable from said tubular; and at least one closure device on the tubular to allow the tubular to be closed off against a well kick or blowout when said bottom hole assembly is removed;

said at least one closure device comprises a plurality of closure devices to allow selective removal of said bottom hole assembly through the tubular on more than one occasion while allowing closing off the tubular upon each removal; and said bottom hole assembly triggers closure of at least one of said closure devices as said bottom hole assembly passes by said closure device as it is removed from the tubular.

2. The assembly of claim 1, wherein:

said closure devices comprise flapper valves.

3. The assembly of claim 1, wherein:

said closure devices comprise packers.

4. The assembly of claim 3, wherein:

said packers are inflatably set to close off the tubular.

5. The assembly of claim 4, wherein:

said packers comprises a respective knock off rod that is actuated by said bottom hole assembly as said bottom hole assembly is removed.

6. The assembly of claim 5, wherein:

said knock off rod, when displaced, triggers inflation of said closure device.

7. The assembly of claim 6, wherein:

said packers are inflated by hydrostatic pressure.

8. The assembly of claim 6, wherein:

said packers further comprise a pressurized fluid source that is actuated by said knock off rod to inflate said packer.

9. The assembly of claim 3, wherein:

said packers are mechanically set to close off the tubular.

10. The assembly of claim 3, wherein:

said packers are set using, at least in part, hydrostatic pressure available in the tubular.

11. The assembly of claim 1, wherein:

said closure devices comprise a respective j-slot mechanism, said bottom hole assembly selectively engaging said respective j-slot mechanism to operate an associated closure device to allow triggering said closure device to a closed position.

12. The assembly of claim 1, wherein:

said closure devices have trip mechanisms that allow a different closure device to be actuated upon successive removals of the bottom hole assembly from the tubular.

13. The assembly of claim 12, further comprising:

a drill device in said bottom hole assembly to drill out the first closure device to be tripped closed when said bottom hole assembly is reinserted.

14. The assembly of claim 12, wherein:

said first closure device is a flapper that is re-latched by said bottom hole assembly after being initially tripped when said bottom hole assembly was removed from the tubular.

15. The assembly of claim 1, wherein:

said bottom hole assembly comprises a side tracking tool.

* * * * *